US012616297B2

(12) United States Patent
Mullins

(10) Patent No.: US 12,616,297 B2
(45) Date of Patent: May 5, 2026

(54) HARD AND FRANGIBLE MATERIAL TABLETOP SYSTEM

(71) Applicant: AGIO INTERNATIONAL COMPANY, LIMITED, Kowloon (CN)

(72) Inventor: Marshall Mullins, Owens Cross Roads, AL (US)

(73) Assignee: Agio International Company, Limited, Hong Kong (CN)

( * ) Notice: Subject to any disclaimer, the term of this patent is extended or adjusted under 35 U.S.C. 154(b) by 123 days.

(21) Appl. No.: 18/650,691

(22) Filed: Apr. 30, 2024

(65) Prior Publication Data

US 2025/0143451 A1 May 8, 2025

Related U.S. Application Data

(60) Provisional application No. 63/547,787, filed on Nov. 8, 2023.

(51) Int. Cl.
*A47B 13/04* (2006.01)
*A47B 7/00* (2006.01)
(Continued)

(52) U.S. Cl.
CPC ..... *A47B 13/04* (2013.01); *A47B 7/00* (2013.01); *A47B 13/003* (2013.01); *A47B 13/06* (2013.01); *A47B 13/08* (2013.01)

(58) Field of Classification Search
CPC ..... A47B 13/04; A47B 13/08; A47B 13/02; A47B 13/06; A47B 13/003; A47B 7/00;
(Continued)

(56) References Cited

U.S. PATENT DOCUMENTS 2,772,936 A * 12/1956 Bargen ..... A47B 13/10 52/658
4,822,661 A 4/1989 Battaglia
(Continued)

FOREIGN PATENT DOCUMENTS

CN 1647721 8/2005
CN 201079145 7/2008
(Continued)

*Primary Examiner* — Janet M Wilkens
(74) *Attorney, Agent, or Firm* — Morse, Barnes-Brown & Pendleton, P.C.; Sean D. Detweiler, Esq.

(57) ABSTRACT

An outdoor table is provided. The table includes a substantially horizontal top structure forming a top surface of the table, having a longest dimension of at most 2300 mm and a shortest dimension of at least 380 mm, and having a substantially uniform thickness of between 3 mm and 20 mm; a metal frame supporting the top structure, where the dimensions of the frame are substantially congruent with, but smaller than, those of the top structure, and comprising at least three penetrations in the bottom of that frame to provide attachment to table legs; at least three table legs; and a binder applied to a top surface of the metal frame, or to the underside of the top structure, opposite to a top surface of the metal frame or both, wherein the top structure is adhered to the frame using only the binder, and where no penetrations are made in the top structure for the attachment of the frame or table legs thereto.

7 Claims, 9 Drawing Sheets

(51) Int. Cl.
*A47B 13/00* (2006.01)
*A47B 13/06* (2006.01)
*A47B 13/08* (2006.01)

(58) Field of Classification Search
CPC .. A47B 37/04; A47B 2200/001; A47B 96/205
USPC ..... 108/161, 27
See application file for complete search history.

(56) References Cited

U.S. PATENT DOCUMENTS 8,522,696 B1 * 9/2013 Lee ..... A47B 13/08 108/27
8,887,648 B2 * 11/2014 Brutter ..... A47B 13/02 108/161
9,095,208 B1 8/2015 Lee et al.
2005/0005827 A1 * 1/2005 Chang ..... A47B 13/08 108/161
2007/0157857 A1 * 7/2007 Bottemiller ..... A47B 11/00 108/103
2007/0227416 A1 * 10/2007 Wang ..... A47B 13/086 108/161
2009/0120334 A1 * 5/2009 Wang ..... A47B 37/04 264/259
2009/0260550 A1 * 10/2009 Colton ..... A47B 13/02 108/158.12
2011/0027566 A1 * 2/2011 Lee ..... B32B 27/302 428/688
2012/0073480 A1 * 3/2012 Korb ..... A47B 91/02 108/147.18
2012/0258278 A1 10/2012 Upham
2017/0203549 A1 7/2017 Garrison
2021/0045526 A1 2/2021 Nieto

FOREIGN PATENT DOCUMENTS

CN 201958150 9/2011
CN 213524317 6/2021
DE 102019127114 A1 * 4/2021 ..... A47B 41/00
GB 661161 11/1951

* cited by examiner

HARD AND FRANGIBLE MATERIAL TABLETOP SYSTEM

RELATED APPLICATION

The present application claims priority from U.S. Provisional No. 63/547,787 filed Nov. 8, 2023, the disclosures of which are incorporated by reference in their entireties.

FIELD OF THE DISCLOSURE

The present disclosure generally relates to a thin, hard and frangible material (e.g., stone) tabletop system.

BACKGROUND

Sintered stone or porcelain tabletops have become popular for indoor and outdoor use. More recently, for aesthetics and in order to save cost and shipping weight, very thin tabletops of these materials have been developed. Unlike wood tabletops and thicker stone or porcelain tops, in which wood or mechanical screws may be used to attach the tabletop structure to a frame, tabletops made from thin, hard and frangible materials, have limitations. One limitation is that it is difficult to drill into these thin, hard and frangible materials, and such drilling may cause permanent cracks or fracture the tabletop entirely. One way of overcoming this limitation has been to glue a plywood sheet to the tabletops and then drill any attachment screws only into the plywood. This has its own limitations in that plywood is often unsightly, and if the table is used outdoors, the plywood tends to warp and/or rot faster than the tabletop material. Further, the extra weight of the plywood diminishes the weight savings achieved by using a thin material to make the tabletop.

Thus a better tabletop system for tables made from a thin, hard and frangible materials like sintered stone or porcelain is desirable.

SUMMARY

The present disclosure provides an outdoor table including a substantially horizontal top structure forming the top surface of the table, having a longest dimension of at most 2200 mm and a shortest dimension of at least 380 mm, and having a substantially uniform thickness of between 3 mm to 20 mm. A metal frame may support such top structure, where the dimensions of the frame are substantially congruent with, but smaller than, those of the top structure. The frame may include at least three penetrations in the bottom of that frame to provide attachment to table legs. A binder may be applied only to the rim of the metal frame wherein the top structure is adhered to the rim so that no penetrations are made in the top structure for the attachment of the frame and/or table legs thereto.

In another embodiment, the dimensions of the frame are greater than those of top structure and provide a captured rim around the perimeter of the top structure.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned features and other features and objects of the present disclosure and the manner of attaining them will become more apparent, and the disclosure itself will be best understood, by reference to the following description of one or more embodiments taken in conjunction with the accompanying drawings, wherein.

DETAILED DESCRIPTION

The foregoing and other aspects of the present disclosure will now be described in more detail with respect to the description and methodologies provided herein. It should be appreciated that the disclosure can be embodied in different forms and should not be construed as limited to the embodiments set forth herein. Rather, these embodiments are provided so that this disclosure will be thorough and complete, and will fully convey the scope of the disclosure to those skilled in the art.

The terminology used in the description of the disclosure herein is for the purpose of describing particular embodiments only and is not intended to be limiting of the disclosure. As used in the description of the embodiments of the disclosure and the appended claims, the singular forms "a", "an" and "the" are intended to include the plural forms as well, unless the context clearly indicates otherwise. Also, as used herein, "and/or" refers to and encompasses any and all possible combinations of one or more of the associated listed items.

As used herein, the terms "comprise," "comprises," "comprising," "include," "includes" and "including" specify the presence of stated features, integers, steps, operations, elements, and/or components, but do not preclude the presence or addition of one or more other features, integers, steps, operations, elements, components, and/or groups thereof.

All patents, patent applications and publications referred to herein are incorporated by reference in their entirety. In case of a conflict in terminology, the present specification is controlling.

Figure 1A:
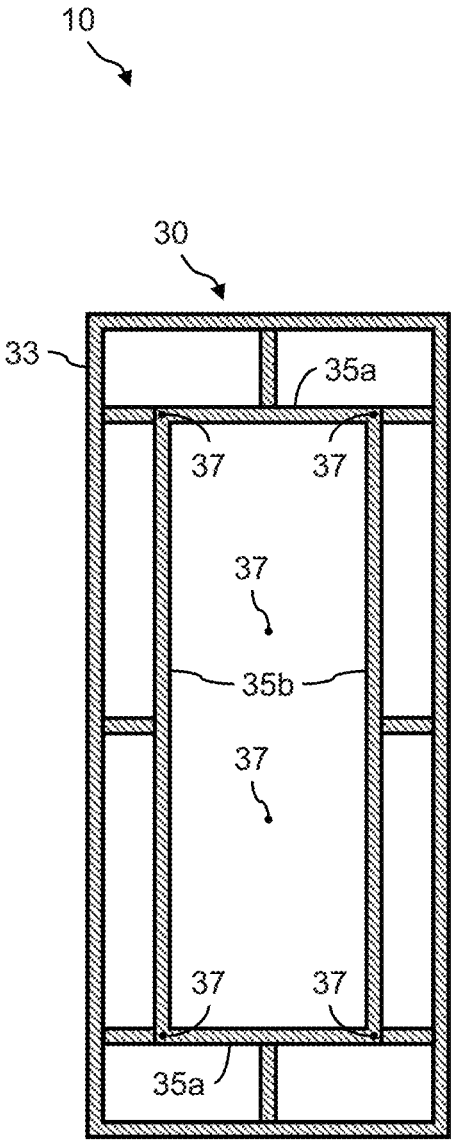
FIG. 1A and FIG. 1B illustrate plan views of an example a metal frame and a top structure, respectively, of an outdoor table, according to an embodiment of the disclosure.
Figure 1B:
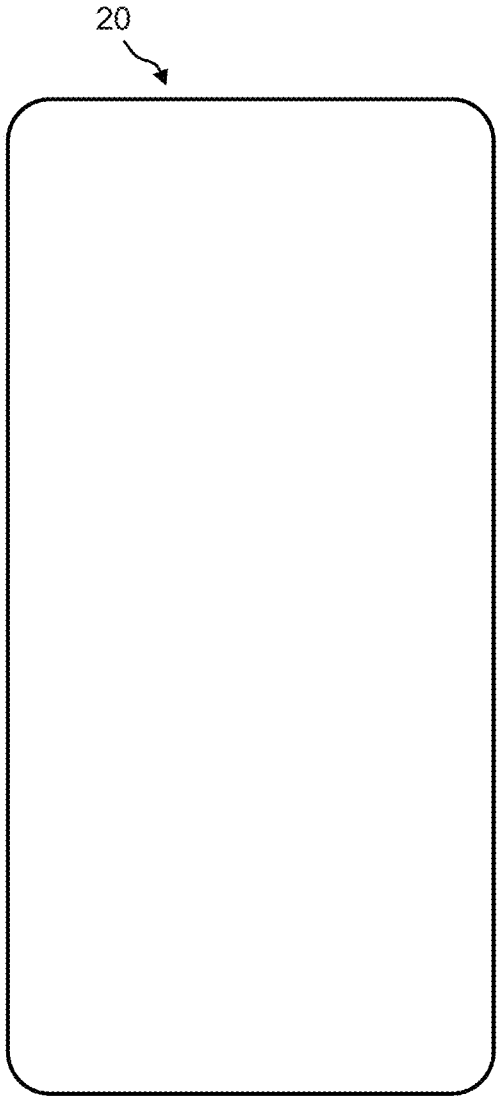
Figure 4:
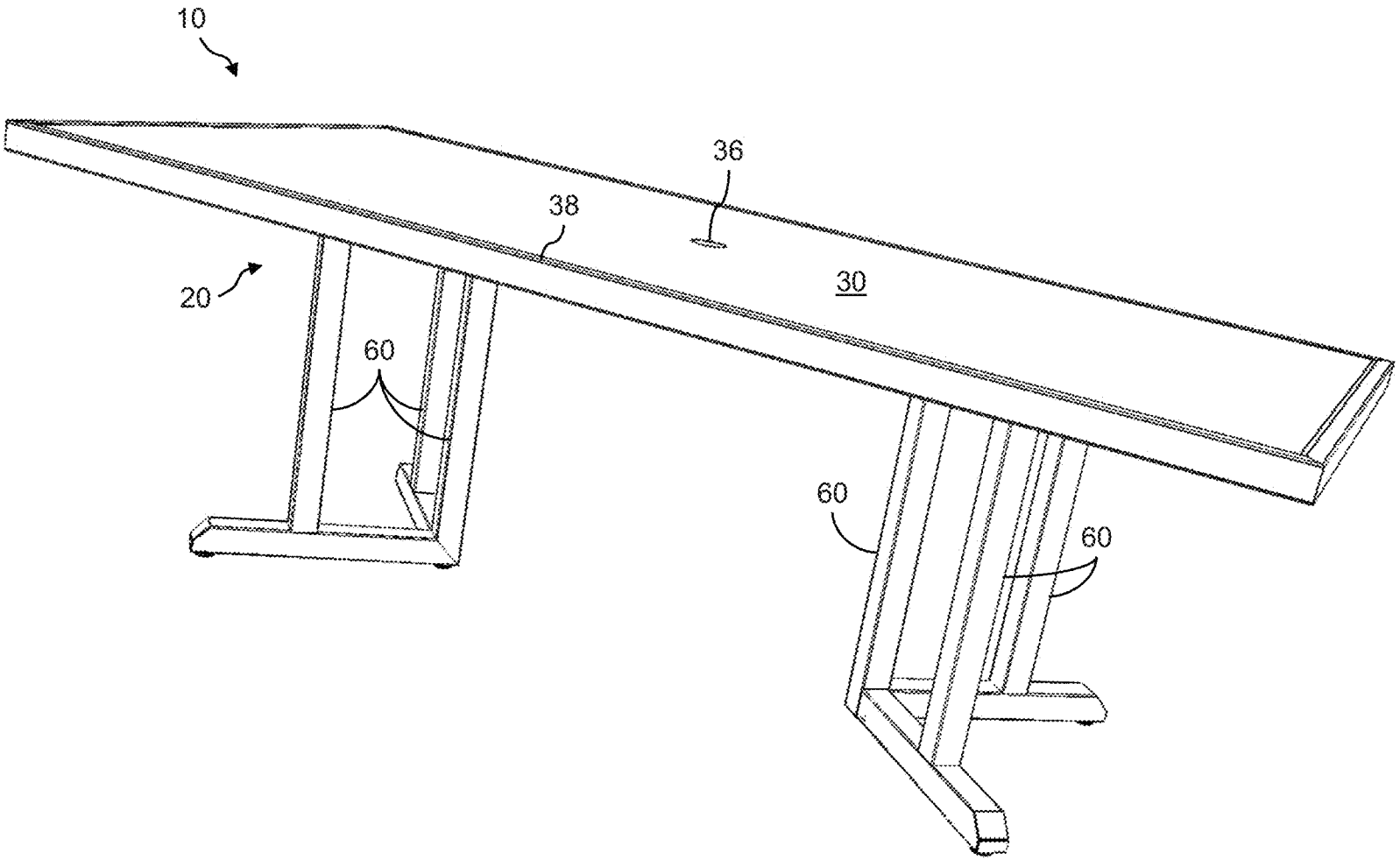
FIG. 4 is a perspective view of an example of a finished table with legs supporting the tabletop, according to an embodiment of the disclosure.
Figure 5:
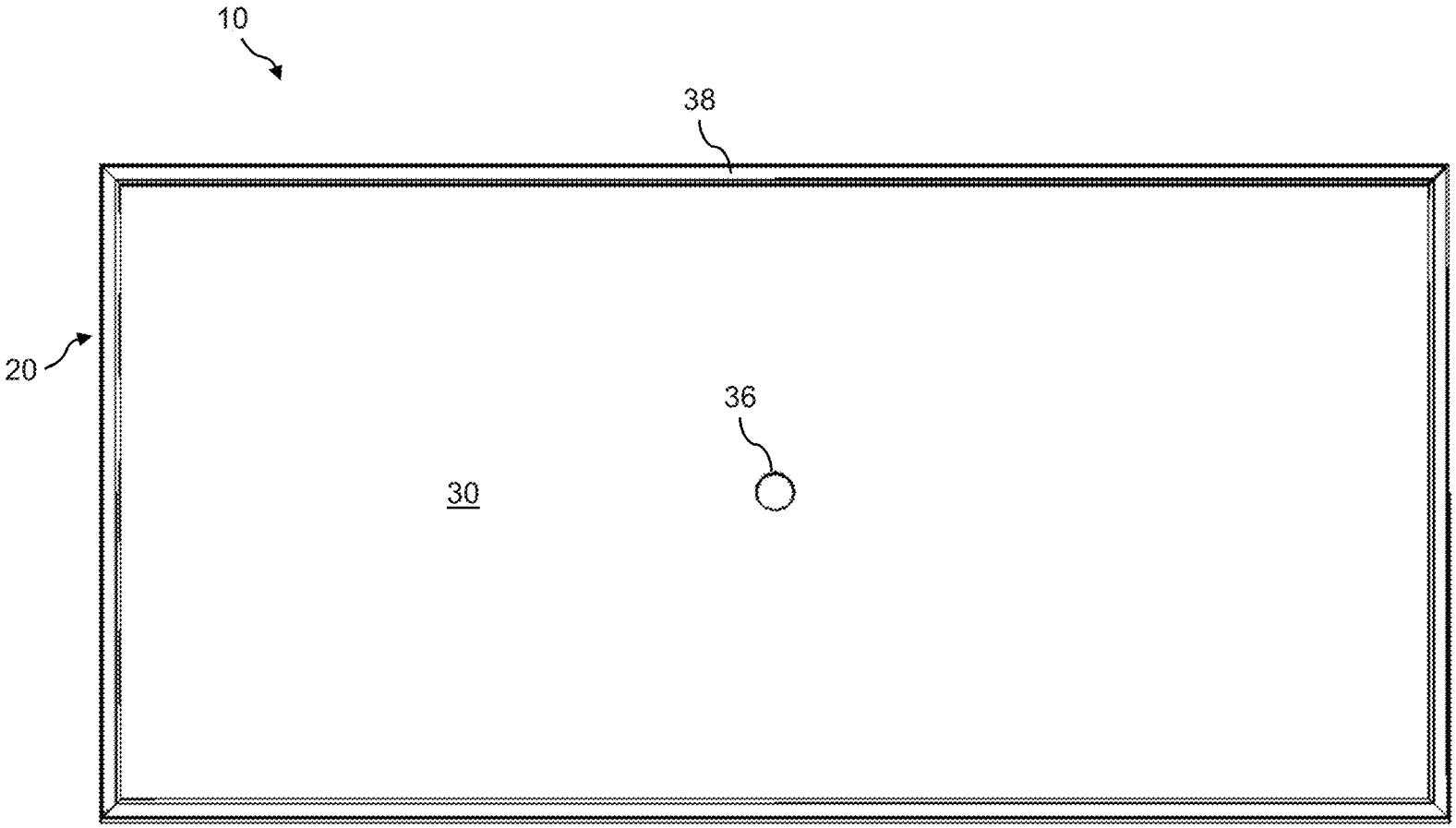
FIG. 5 illustrates a top view of the finished table shown in FIG. 4, according to an embodiment of the disclosure.
Figure 6:
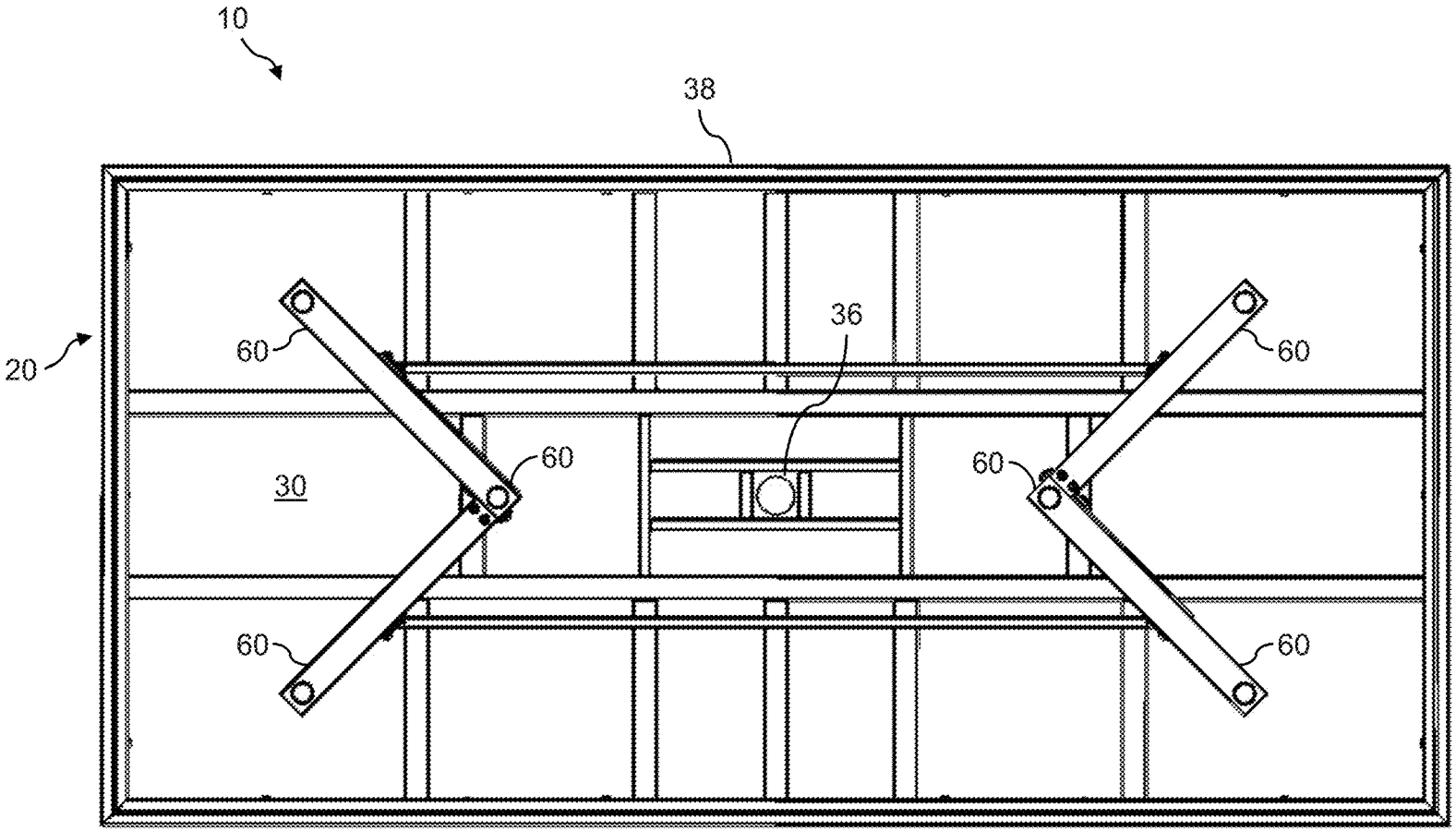
FIG. 6 illustrates a bottom view of the finished table shown in FIG. 4, according to an embodiment of the disclosure.
Figure 7:
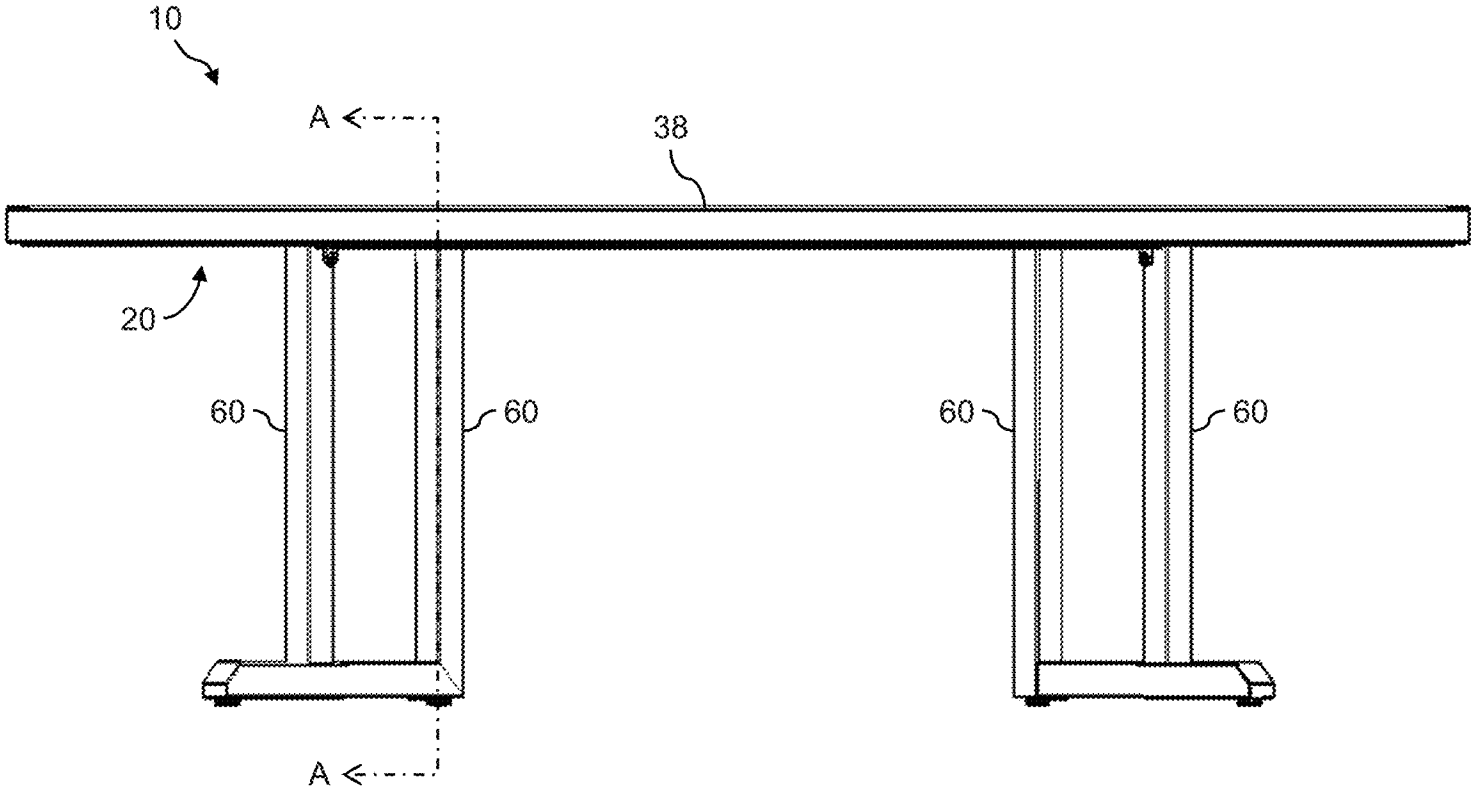
FIG. 7 illustrates a side view of the finished table shown in FIG. 4, according to an embodiment of the disclosure.
Figure 8:
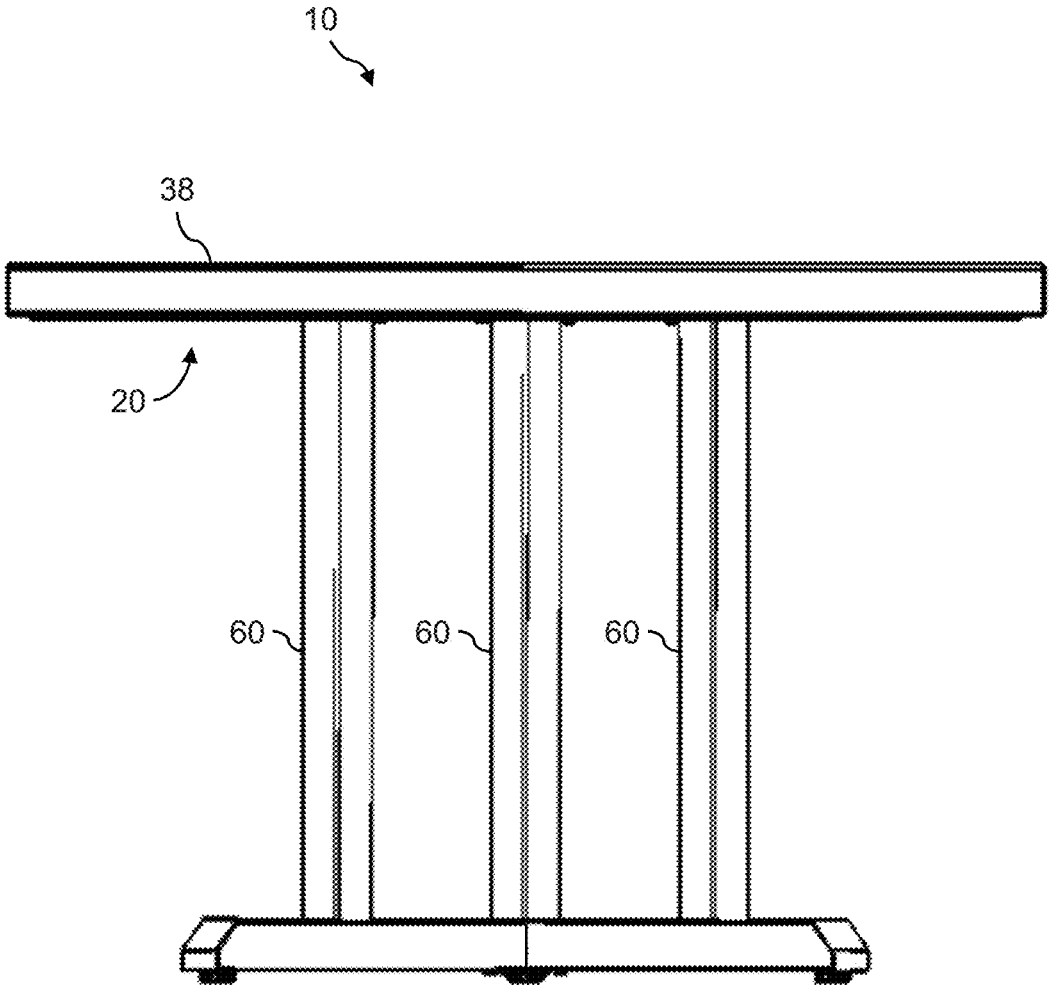
FIG. 8 illustrates an end view of the finished table shown in FIG. 4, according to an embodiment of the disclosure.
Figure 9:
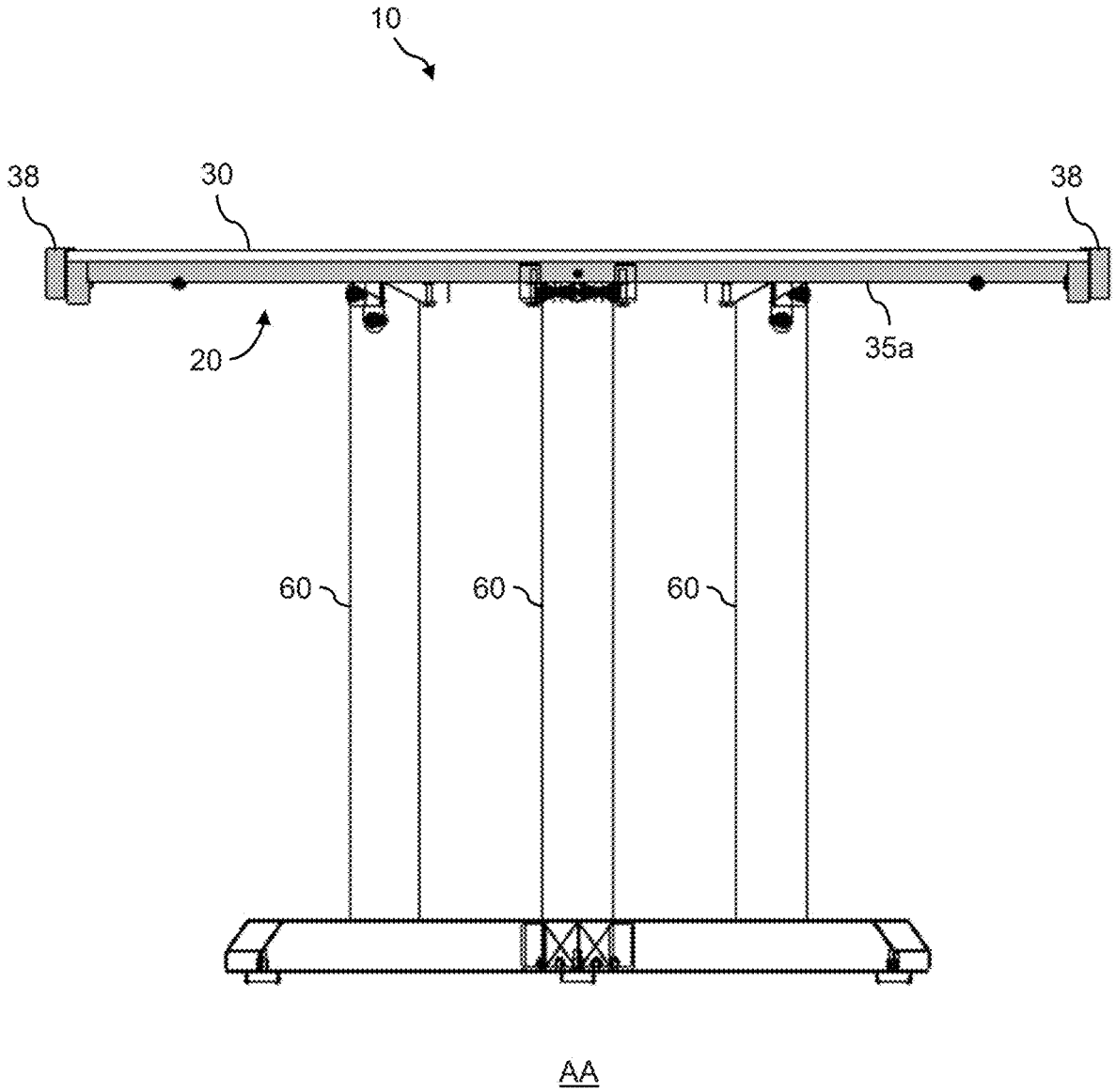
FIG. 9 illustrates a cross-sectional view of the finished table shown in FIG. 4 taken along line AA of FIG. 7, according to an embodiment of the disclosure.

The present disclosure provides a tabletop system comprised of a tabletop made of a thin, hard and frangible material, a frame to which the tabletop on one side, and table legs on the other, may be attached, and a binder to attach the tabletop to the frame. This system obviates the problems associated with the use of thicker or less frangible materials, or the need to use substructures to which a frame and/or table legs may be attached. Referring to FIGS. 1A and 1B, the tabletop system 10 may include a horizontal top structure 20 and a metal frame 30 for supporting the top structure 20. The horizontal top structure 30 as depicted in FIGS. 1A and 1B may be in the shape of a rectangle. Other shapes may be utilized such as a square, circle, pentagon, octagon, and may be oblong and the like. The top structure 20 may also include top inlays and other decorative effects (not shown). The top structure 20 may include an opening 35 (See, FIG. 4) for an umbrella, lighting structure, heater or the like.

The top structure 20 may be of any thin, hard and frangible material including stone, wood, polymeric composite, with or without stone in-lays, and the like. In one embodiment, the top structure may be stone or may resemble stone, and may be formed of one or more of stone, sintered stone, marble, quartz, granite, slate, clay, tile, ceramic or porcelain.

The top structure 20 may have a longest dimension of at most 2300 mm and a shortest dimension of at least 380 mm. The preferred length and width range for a rectangular table is between 450 mm by 450 mm to 2100 mm by 1150 mm. The preferred range for a round/circular table is 450 mm to 1600 mm. The preferred range for an oblong or oval table may fall within these preferred ranges, depending on the actual shape. The minimum dimensions may be dependent on commercial factors including weight, cost and aesthetics. The maximum dimensions may be dependent on commercial factors and the structural integrity of the tabletop system 10. The top structure 20 may have a substantially uniform thickness of between 3 mm to 20 mm, and in a preferred embodiment has a thickness between 6 mm to 13 mm. In operation, the minimum thickness may be based on the characteristics of the specific sintered stone selected and its ability not to fracture or splinter at thicknesses less than about 5 mm. The maximum thickness of the top structure 20 may also be based on the specific sintered stone and may be dependent on aesthetics, weight and/or cost of the sintered stone. The thickness of the metal frame 30 is between 15 mm and 80 mm. The thickness of the metal frame 30 may be dependent on the selected sintered stone and may also be dependent on commercial factors including weight, cost, aesthetics and the overall dimensions of the top structure 20. The thickness of the top structure 20 and the metal frame 30 together may be about 25 mm to 80 mm, and may depend on a combination of the commercial factors outlined above.

The metal frame 30 supports the horizontal top structure 20 and in one embodiment is dimensioned to be substantially congruent with, but somewhat smaller than, the top structure 20. The metal frame 30 may include a rim 33, a series of interconnected horizontally oriented traverse members 35*a* and vertically oriented traverse members 35*b* extending perpendicularly from a long side and a short side of the rim 33, respectively. The traverse member 35*a*, 35*b* and the rim 33 provide support for the top structure 20. The metal frame may include attachment holes 37 for the attachment of at least three table legs 60. (See, FIG. 4). No screws or other attachment means are necessary to attach the legs to the top structure 20. The metal frame 30 may be made from any one of aluminum, steel or iron.

In another embodiment, the dimension of the metal frame may be congruent with but greater than the top structure in order to provide an outer (captured) rim which surrounds the perimeter of the tabletop (not shown).

Figure 2:
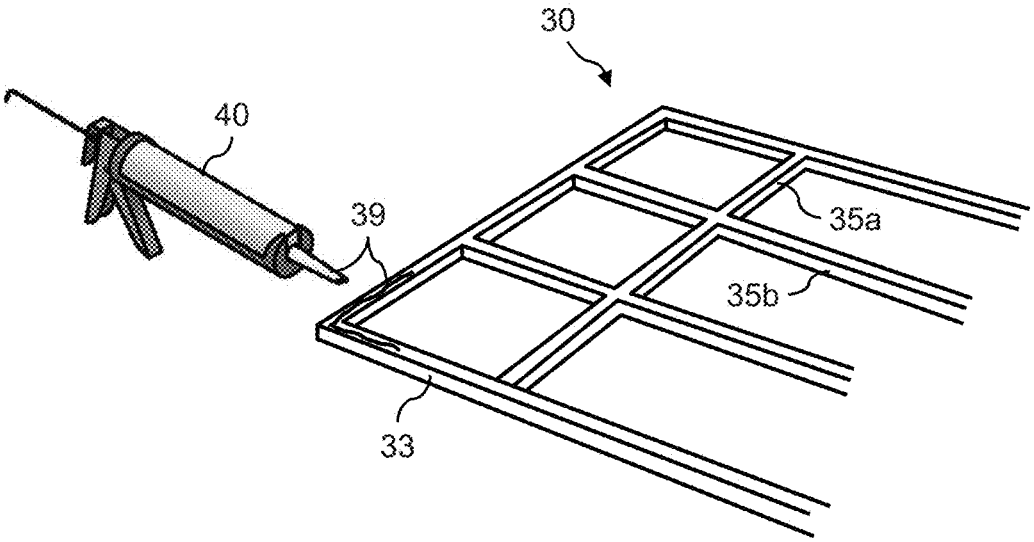
FIG. 2 illustrates a perspective view of a binder being applied to the metal frame, according to an embodiment of the disclosure.
Figure 3:
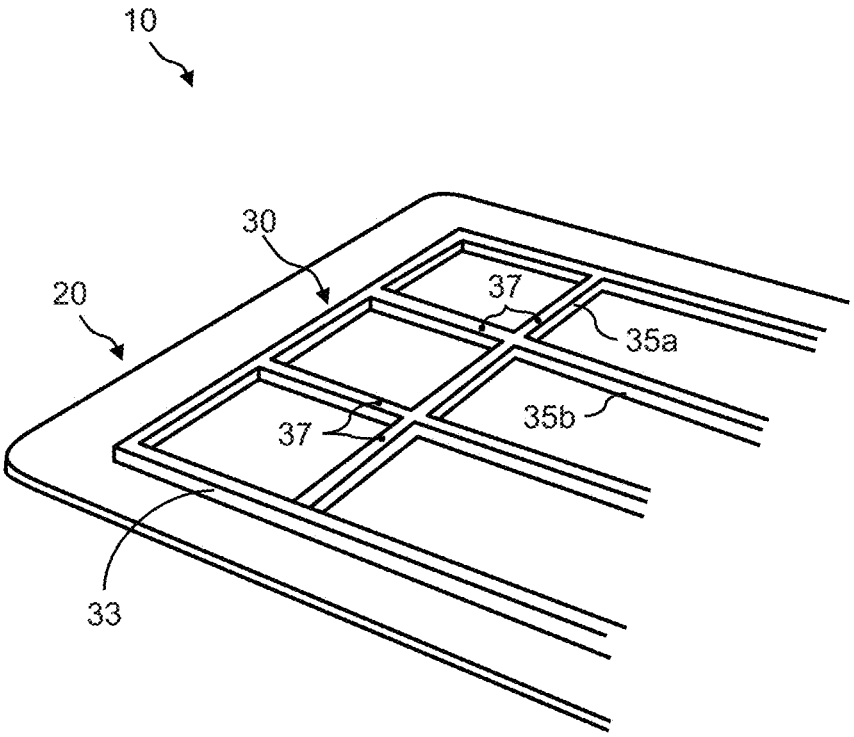
FIG. 3 is a perspective view of the top structure attached to the metal frame, according to an embodiment of the disclosure.

Referring to FIGS. 2 and 3, the application of a binder to the rim 33 and traverse members 35*a*, 35*b* of the metal frame 30 is illustrated. A binder 39 is applied using a conventional applicator 40 such as a glue or caulking gun as shown. The binder may be applied only to the top of the rim, only to the top of the traverse members, to the top of both, or to the underside of the top structure 20 opposite those frame elements. The binder may be any commercially available resin for bonding hard and frangible materials like stone to metal, and may include unsaturated polymer resins, vinyl resins and epoxy resins.

By using and applying the binder 39 to the rim 33 and traverse members 35*a*, 35*b* of the metal frame 30, the only screws necessary are the screws for attaching the legs 60 to the metal frame 30 of the tabletop system. No screws or other attachment means are necessary for attachment of any system element to the top structure 20. Thus, there is no penetration into the top structure 20, and cracking or fracturing of the material of the top structure 20 is avoided.

Although the present approach has been described herein with referenced to certain embodiments of the present disclosure, it is to be understood that the disclosure defined by the appended claims is not to be limited by particular details set forth in the above description as may perform similar functions and/or achieve like results. All such equivalent embodiments and examples are within the spirit and scope of the present approach.

That which is claim is:

1. An outdoor table comprising:

a substantially horizontal top structure forming a top surface of the table, having a longest dimension of at most 2300 mm and a shortest dimension of at least 380 mm, and having a substantially uniform thickness of between 3 mm and 20 mm;

a metal frame supporting the top structure, where the dimensions of the frame are substantially congruent with those of the top structure, and comprising at least three penetrations in the bottom of that frame to provide attachment to table legs;

at least three table legs; and a binder applied only to a top surface of a rim of the metal frame, or to the underside of the top structure, opposite to the top surface the rim of the metal frame or both, wherein the top structure is adhered to the rim of the frame using only the binder, and where no penetrations are made in the top structure for the attachment of the frame or table legs thereto.

2. The outdoor table according to claim 1, wherein the horizontal top structure is natural or man-made stone.

3. The outdoor table according to claim 2, wherein the horizontal top structure is selected from the group consisting of stone, sintered stone, granite, quartz, marble, clay, slate, tile, porcelain, ceramic and cement.

4. The outdoor table according to claim 1, wherein the binder is a resin selected from the group consisting of unsaturated polymer resins, vinyl resins and an epoxy resins.

5. The outdoor table according to claim 1, wherein the metal frame is formed from aluminum, steel and iron.

6. The outdoor table according to claim 1, wherein dimensions of the metal frame are greater than dimensions of the top structure of the top surface of the table to form a captured rim.

7. The outdoor table according to claim 1, wherein dimensions of the metal frame are smaller than dimensions of the top structure of the top surface of the table.

* * * * *